US011828421B2

(12) United States Patent
Pasquier et al.

(10) Patent No.: US 11,828,421 B2
(45) Date of Patent: Nov. 28, 2023

(54) METHOD FOR CONTROLLING THE FILLING LEVELS OF TANKS

(71) Applicant: Gaztransport Et Technigaz, Saint Remy les Chevreuse (FR)

(72) Inventors: Romain Pasquier, Saint Remy les Chevreuse (FR); Eric Gervaise, Saint Remy les Chevreuse (FR); Nicolas Leroux, Saint Remy les Chevreuse (FR); Bruno Robillart, Saint Remy les Chevreuse (FR)

(73) Assignee: Gaztransport Et Technigaz, Saint Remy les Chevreuse (FR)

( * ) Notice: Subject to any disclaimer, the term of this patent is extended or adjusted under 35 U.S.C. 154(b) by 558 days.

(21) Appl. No.: 17/059,699

(22) PCT Filed: May 28, 2019

(86) PCT No.: PCT/FR2019/051246
§ 371 (c)(1),
(2) Date: Nov. 30, 2020

(87) PCT Pub. No.: WO2019/229368
PCT Pub. Date: Dec. 5, 2019

(65) Prior Publication Data

US 2021/0207773 A1 Jul. 8, 2021

(30) Foreign Application Priority Data

May 31, 2018 (FR) ..... 1854735

(51) Int. Cl.
*F17C 6/00* (2006.01)
*F17C 13/02* (2006.01)

(52) U.S. Cl.
CPC ..... *F17C 6/00* (2013.01); *F17C 13/02* (2013.01); *F17C 2201/0157* (2013.01);
(Continued)

(58) Field of Classification Search
CPC ..... F17C 13/02; F17C 2221/033; F17C 2250/032; F17C 2250/0465;
(Continued)

(56) References Cited

U.S. PATENT DOCUMENTS 6,298,671 B1 * 10/2001 Kennelley ..... F17C 1/007 62/50.2
2015/0108137 A1 * 4/2015 Nettis ..... F17C 5/06 220/560.04
2016/0343092 A1 * 11/2016 Legrand ..... G06Q 50/06

FOREIGN PATENT DOCUMENTS

CN 101520127 A 9/2009
CN 102667302 A 9/2012
(Continued)

*Primary Examiner* — Chun Cao
(74) *Attorney, Agent, or Firm* — Blank Rome LLP

(57) ABSTRACT

A method for managing the filling levels of a plurality of tanks arranged in a ship, said tanks being connected in such a way as to allow liquid to be transferred between said tanks, the method comprising providing an initial state (7) of the tanks, determining a target state (8) defining respective final filling levels of said tanks, determining a liquid transfer scenario (9), the transfer scenario defining one or more flows of liquid to be transferred between the tanks during a transfer period in order to shift from the initial state to the target state of the tanks, calculating a probability of damage to the tanks (10) during the course of said transfer scenario, as a function of successive filling levels of the tanks during the transfer period, if the probability of damage to the tanks satisfies an acceptance criterion, transferring (13) the liquid between the tanks in accordance with said transfer scenario.

14 Claims, 3 Drawing Sheets

(52) U.S. Cl.
CPC ..... *F17C 2201/052* (2013.01); *F17C 2205/0134* (2013.01); *F17C 2221/033* (2013.01); *F17C 2223/0161* (2013.01); *F17C 2227/0135* (2013.01); *F17C 2250/032* (2013.01); *F17C 2250/036* (2013.01); *F17C 2250/0408* (2013.01); *F17C 2250/0439* (2013.01); *F17C 2250/0473* (2013.01); *F17C 2250/0482* (2013.01); *F17C 2250/061* (2013.01); *F17C 2250/0636* (2013.01); *F17C 2250/0694* (2013.01); *F17C 2260/016* (2013.01); *F17C 2270/0105* (2013.01)

(58) Field of Classification Search
CPC ..... F17C 2250/0482; F17C 2250/0636; F17C 2270/0105; F17C 13/00; F17C 2201/0157; F17C 2201/052; F17C 2205/0134; F17C 2223/0161; F17C 2223/033; F17C 2225/0161; F17C 2225/033; F17C 2227/0135; F17C 2250/036; F17C 2250/0408; F17C 2250/0439; F17C 2250/0473; F17C 2250/061; F17C 2250/0694; F17C 2250/07; F17C 2260/016; F17C 6/00; F17C 13/021; F17C 13/12; F17C 2201/0109; F17C 2201/056; F17C 2201/058; F17C 2203/0604; F17C 2203/0639; F17C 2203/0646; F17C 2203/0663; F17C 2203/0673; F17C 2221/012; F17C 2223/0123; F17C 2223/036; F17C 2250/034; F17C 2250/0469; F17C 2260/042; F17C 2270/0171; F17C 2270/0189; B60K 15/03006; B60K 2015/0301; B60K 2015/03046; B60K 2015/0321; B60K 2015/03315; B60K 2015/03375; B60K 2015/03381; B60K 2015/03407; B60Y 2306/15; B60Y 2400/305
USPC ..... 700/281
See application file for complete search history.

(56) References Cited

FOREIGN PATENT DOCUMENTS

| | | | |
|---|---|---|---|
| CN | 104718408 | A | 6/2015 |
| CN | 106170803 | A | 11/2016 |
| CN | 106335601 | A | 1/2017 |
| CN | 102421664 | A | 4/2021 |
| FR | 2691520 | A1 | 11/1993 |
| FR | 2877638 | A1 | 5/2006 |
| JP | H08310482 | A | 11/1996 |
| JP | H107190 | A | 1/1998 |
| JP | H107190 | A | 1/1998 |
| KR | 20060107833 | A | 10/2006 |
| WO | WO2014057221 | A2 | 4/2014 |

* cited by examiner

METHOD FOR CONTROLLING THE FILLING LEVELS OF TANKS

RELATED APPLICATIONS

The present application is a national stage of International Application No. PCT/FR2019/051246, filed May 28, 2019, which claims priority to French Patent Application No. 1854735, filed May 31, 2018, both of which are incorporated herein by reference.

TECHNICAL FIELD

The invention relates to the field of tanks arranged in a floating structure such as a ship, such as sealed and thermally insulating tanks with membranes. In particular, the invention relates to the field of sealed and thermally insulating tanks for storing and/or transporting low-temperature liquefied gas, such as tanks for transporting Liquefied Petroleum Gas (LPG) having, for example, a temperature of between −50° C. and 0° C., or for transporting Liquefied Natural Gas (LNG) at approximately −162° C. at atmospheric pressure. These tanks can be intended for transporting liquefied gas or for receiving liquefied gas for use as fuel for the propulsion of the floating structure.

In one embodiment, the liquefied gas is LNG, i.e. a mixture with a high methane content stored at a temperature of approximately −162° C. at atmospheric pressure. Other liquefied gases can also be envisaged, in particular ethane, propane, butane or ethylene. Liquefied gases can also be stored under pressure, for example at a relative pressure of between 2 and 20 bars, and in particular at a relative pressure close to 2 bar. The tank can be produced according to different techniques, in particular in the form of an integrated membrane tank or a structural tank.

TECHNOLOGICAL BACKGROUND

During storage and/or transportation, the liquid contained in a tank is subjected to different movements. In particular, the movements of a ship at sea, for example under the effect of climatic conditions such as sea state or wind, cause agitation of the liquid in the tank. The agitation of the liquid, generally referred to as "sloshing", puts stress on the walls of the tank which can damage the integrity of the tank. However, the integrity of the tank is particularly important in the context of an LNG tank, due to the flammable or explosive nature of the transported liquid and the risk of cold spots on the steel hull of the floating unit.

In order to reduce the risks of damage to the tanks linked to the movements of liquid in the tanks, LNG carriers generally sail with empty or, on the contrary, full tanks. Indeed, in an empty tank, the weight of the residual liquid contained in the tank is limited and puts only minor stress on the tank walls. In a full tank, the residual space not occupied by the liquid in the tank is limited, which accordingly limits the freedom of movement of the liquid in the tank and therefore the force of impacts on the tank walls. Therefore, LNG carriers generally need to sail with their tanks filled to less than 10% of their capacity or, on the contrary, to more than 70% of their capacity, in order to limit the risks of damage to the walls of tanks linked to impacts of liquid moving in the tanks.

There is known document JP H107190 which describes a method for managing the filling levels of a plurality of tanks of a ship transporting cryogenic liquid. In this document, the transfer of liquid from one tank to another is performed when it is determined that, in one tank, the movement of the liquid that it contains is nearing its resonance period, giving rise to the risk of negative repercussions in terms of damage to the tank ("sloshing").

SUMMARY

This filling state of the tanks represents an ideal theoretical filling state that is not always possible to achieve. In particular, in the event that a ship makes an emergency departure while loading or unloading its cargo, the ship may be required to go to sea with partially filled tanks. Indeed, the operations of loading and unloading the liquid contained in the tanks are lengthy operations that therefore need to be stopped prematurely in the event of an alert requiring an emergency departure. Such alerts can be linked to many reasons such as, for example, a natural disaster such as a tsunami or an earthquake, or an alert linked to damage to the port facilities.

One idea underlying some embodiments of the invention is that of limiting the risks linked to movements of liquid in a ship at sea comprising a plurality of partially filled tanks. One idea underlying some embodiments of the invention is that of transferring the liquid between tanks having filling levels that risk damage in order to obtain filling levels in said tanks comprising a lower risk of damage. One idea underlying some embodiments of the invention is that of providing one or more transfer scenarios for shifting from an initial filling state of the tanks to a target filling state of said tanks. One idea underlying some embodiments of the invention is that of transferring the liquid between the tanks according to a transfer scenario having a satisfactory level of safety during the course of said transfer scenario. For this purpose, one idea underlying some embodiments of the invention is that of calculating probabilities of damage to the tanks during the course of one or more transfer scenarios.

According to one embodiment, the invention provides a method for managing the filling levels of a plurality of tanks arranged in a ship, said tanks being connected in such a way as to allow liquid to be transferred between said tanks, the method comprising

- providing an initial state defining initial filling levels of the tanks,
- determining at least one target state defining final filling levels of said tanks,
- determining a liquid transfer scenario, the transfer scenario defining one or more flows of liquid to be transferred between the tanks during a transfer period in order to shift from the initial state to the target state of the tanks,
- calculating a probability of damage to the tanks as a function of successive filling levels of the tanks during the transfer period, the probability of damage to the tanks defining a probability that at least one tank will be damaged during the course of the transfer scenario,
- generating a series of instructions intended to transfer the liquid between the tanks in accordance with said transfer scenario if the probability of damage to the tanks satisfies an acceptance criterion.

The method according to the invention defines at least one transfer scenario for transferring liquid (liquefied gas), preferably a plurality of transfer scenarios for transferring liquid, between the tanks in such a way that an operator, or the crew, is able to choose the scenario it desires. In this case, the plurality of scenarios proposed to the operator are all intended to reduce the risk of damage to the tanks; however, these scenarios may differ from each other in terms of the time required to complete them and the final filling levels of each of the tanks.

As a result of these features, the risk of damage to the tanks is evaluated for the transfer scenario, taking into account the successive filling levels of the tanks during the transfers. Thus, as a result of these features, the risk of damage to the tanks is calculated not only for the target state to be achieved but also during the transfer of liquid.

Thus, when a ship transporting liquefied gas is docked, with its tanks at least partially loaded, the invention allows the crew or an operator to return as quickly as possible to a safe situation, for example when a storm requires the boat to leave its mooring or in the event that the boat needs to leave quickly.

According to some embodiments, such a management method may comprise one or more of the following features.

According to one embodiment, the probability of damage to the tanks of the target state is lower than the probability of damage to the tanks of the initial state.

As a result of these features, a ship whose tanks are partially filled can be made safe by transferring the liquid contained in said tanks between them in order to achieve a safer filling state of the tanks.

According to one embodiment, the management method further comprises, if the probability of damage to the tanks satisfies the acceptance criterion, transferring the liquid between the tanks in accordance with said transfer scenario.

According to one embodiment, the management method further comprises the step of providing a transfer capacity parameter defining a transfer capacity between the tanks, the transfer scenario being determined as a function of said parameter defining the transfer capacity between the tanks.

According to one embodiment, the transfer capacity parameter comprises a parameter defining the number of pumps for one, some or each of the tanks.

According to one embodiment, the transfer capacity parameter comprises a parameter defining the pumping flow rate of the pump or pumps of the tanks.

According to one embodiment, the transfer capacity parameter comprises a parameter defining the volume of the tanks. According to one embodiment, the parameter defining the transfer capacity between the tanks comprises one or more parameters defining the diameter of the connecting pipes between the tanks.

According to one embodiment, the management method further comprises a step of providing at least one environmental parameter defining environmental data of the ship, the probability of damage to the tanks being calculated as a function of said at least one environmental parameter.

According to one embodiment, the environmental parameter or parameters comprise one or more of the following parameters: wind sea height, swell height, wind sea period, swell period, wind sea direction, swell direction, wind force, wind direction, current force, current direction, relative direction of the wind, the swell, the current, the wind sea relative to the ship.

Preferably, the environmental parameter or parameters comprise the sea height or swell height and, more preferably still, sea height and swell height are the two environmental parameters considered, at a minimum, by the method according to the invention.

According to one embodiment, the probability of damage to the tanks is calculated as a function of at least one parameter chosen from the group of parameters comprising the movements of the ship, the levels of liquid impacts on the tank walls, the statistical behavior of the impacts of the movements of liquid, the strength of the tanks depending on the position in said tanks, the time spent at different filling levels, the gas evaporation rate induced by the transfer of liquid, the loading state of the ship's structure.

Preferably, the calculation of the probability of damage considers at least the statistical behavior of the impacts of the movements of liquid or the time spent at different filling levels, and, more preferably still, the statistical behavior of the impacts of the movements of liquid and the time spent at different filling levels are the two parameters considered, at a minimum, for the damage calculation.

According to one embodiment, the filling level of a tank is determined by the height of liquid in said tank. According to another embodiment, the filling level of a tank is determined by a volume of liquid contained in said tank.

According to one embodiment, the management method further comprises the step of determining a parameter in real time and taking said parameter into account in order to determine the transfer scenario.

According to one embodiment, the management method further comprises the step of determining a parameter in real time and taking said parameter into account in order to determine the calculation of probability of damage to the tanks.

According to one embodiment, the ship comprises one or more sensors for providing a parameter of the transfer scenario in real time, in particular the initial filling levels, the capacities of the tanks, the flow rates of the pumps, etc.

According to one embodiment, the ship comprises one or more sensors for providing a parameter of the calculation of probability of damage to the tanks in real time, in particular the movements of the ship, the environmental parameters, etc.

According to one embodiment, the ship comprises a database comprising data corresponding to one or more parameters of the transfer scenario.

According to one embodiment, the ship comprises a database comprising data corresponding to one or more parameters of the calculation of probability of damage to the tanks.

According to one embodiment, the acceptance criterion is a criterion concerning the risk of damage to the tanks during the course of the transfer scenario.

According to one embodiment, the probability of damage to the tanks is calculated according to the following formula:

$$\mathrm{Risk}_{ope} = \prod_{tk_n} \int_0^{surf} \int_0^{t_{ope}} prob_{tk_n}(Pres_{surf} > Res_{surf}, \mathrm{tk_n}, SC(\mathrm{fl_n})) \cdot dsurf \cdot dt$$

in which tk_n represents the number of the tank n,

SC represents the sailing conditions as a function of the filling level fl_n of the tank tk_n, $\mathrm{Prob}_{tk_n}$ represents the probability density of encountering a pressure $\mathrm{Pres}_{surf}$ on an internal surface of the tank tk_n greater than the strength $\mathrm{Res}_{surf}$ of said internal surface of the tank tk_n as a function of the sailing conditions SC(fl_n), surf is the internal surface impacted by the liquid, and $t_{ope}$ is the duration of the operation to shift from the initial state to the target state.

According to one embodiment, the sailing conditions SC also depend on at least one of the following parameters:

the angle of incidence between the sea state and the ship the period of the sea state the significant height of the sea state the movements of the ship the forward speed of the ship.

It should be noted that a sea state can be broken down into wind sea and swell, and even cross swell. Therefore, a sea state can be defined with several components.

According to one embodiment, the probability density $Prob_{tk_n}(Pres_{surf}>Res_{surf}, tk_n, SC(fl_n)$ is predefined.

According to one embodiment, the probability density or densities of damage to the tank are predefined based on liquid movement tests performed in a laboratory. According to one embodiment, the laws of probability of damage to the tank are predefined by means of data acquisition campaigns on ships at sea.

According to one embodiment, the method further comprises the step of continuously monitoring the actual successive states of the tanks during the transfer period and, in response to the detection of a discrepancy between the actual successive states of the tanks and the predicted successive states of tanks determined by the transfer scenario, repeating the method defined above.

According to one embodiment, the method further comprises:

determining a plurality of different transfer scenarios, each transfer scenario defining one or more flows of liquid to be transferred between the tanks during a respective transfer period in order to shift from the initial state to the target state, calculating, for each transfer scenario, a respective probability of damage to the tanks as a function of successive filling levels of the tanks during the corresponding transfer period, the probability of damage to the tanks defining a probability that at least one tank will be damaged during the course of said transfer scenario, selecting one scenario from the plurality of transfer scenarios, and generating the series of instructions intended to transfer the liquid between the tanks in accordance with the selected transfer scenario if the corresponding probability of damage to the tanks satisfies an acceptance criterion.

According to one embodiment, the method further comprises:

determining a plurality of target states, each target state defining final filling levels of the tanks, determining a plurality of different transfer scenarios, each transfer scenario defining one or more flows of liquid to be transferred between the tanks during a respective transfer period in order to shift from the initial state to one target state from the plurality of target states, calculating, for each transfer scenario, a respective probability of damage to the tanks as a function of successive filling levels of the tanks during the corresponding transfer period, the probability of damage to the tanks defining a probability that at least one tank will be damaged during the course of said transfer scenario, selecting one scenario from the plurality of transfer scenarios, and generating the series of instructions intended to transfer the liquid between the tanks in accordance with the selected transfer scenario if the corresponding probability of damage to the tanks satisfies an acceptance criterion.

According to one embodiment, one or more scenarios can therefore be determined for one or more or each of the target states.

According to one embodiment, the transfer scenario is selected depending on the probability of damage to the tanks, for example in order to minimize this probability.

According to one embodiment, the scenario is selected depending on the acceptance criterion.

The scenario can be selected depending on various acceptance criteria.

According to one embodiment, the scenario is selected depending on the time spent exposed to the risk of damage to the tanks linked to the movements of liquid in the tanks. According to another embodiment, the scenario is selected depending on the transfer time of the scenarios. According to one embodiment, the scenario is selected depending on a volume of gas available in the tanks at the end of the transfer scenario for supplying propulsion means of the vessel, e.g. a gas-consuming engine.

According to one embodiment, certain parameters such as, for example, the level of movement of liquid in the tanks, the movements of the ship and/or the weather are determined in real time, for example by onboard sensors.

According to one embodiment, certain parameters such as, for example, the level of movement of liquid in the tanks, the movements of the ship and/or the weather are determined by prediction.

According to one embodiment, the liquid is a liquefied gas, for example liquefied natural gas.

According to one embodiment, the invention also provides a computer-implemented system for managing the filling levels of tanks comprising means for:

providing an initial state defining initial filling levels of the tanks, determining a target state defining final filling levels of said tanks, determining a liquid transfer scenario, the transfer scenario defining one or more flows of liquid to be transferred between the tanks during a transfer period in order to shift from the initial state to the target state of the tanks, calculating a probability of damage to the tanks as a function of successive filling levels of the tanks during the transfer period, the probability of damage to the tanks defining a probability that at least one tank will be damaged during the course of the transfer scenario, generating a series of instructions intended to transfer the liquid between the tanks in accordance with said transfer scenario if the probability of damage to the tanks satisfies an acceptance criterion.

According to one embodiment, the management system further comprises a data acquisition means, for example one or more sensors or one or more means of data entry by an operator. According to one embodiment, the management system further comprises a data display means. According to one embodiment, the means of the management system for carrying out the steps indicated above are, or comprise, at least one processor and at least one memory comprising an integrated software module.

Such a management method or system for managing the filling levels of tanks can be installed in a coastal or deep water floating structure, in particular an LNG carrier ship, a floating storage and regasification unit (FSRU), a remote floating production, storage and offloading (FPSO) unit, a barge or in other applications.

According to one embodiment, the invention also provides a ship for transporting a cold liquid product comprising a double hull, a plurality of tanks and the abovementioned management system.

BRIEF DESCRIPTION OF THE FIGURES

The invention will be more clearly understood, and other aims, details, features and advantages of same will become clearer on reading the following description of several specific embodiments of the invention, provided as purely illustrative and non-limiting examples, with reference to the appended drawings.

DETAILED DESCRIPTION OF EMBODIMENTS

The figures are described hereinafter in the context of a ship 1 comprising a double hull forming a load-bearing structure in which a plurality of sealed and thermally insulating tanks are arranged. Such a load-bearing structure has, for example, polyhedral geometry, for example being prismatic in shape.

Such sealed and thermally insulating tanks are designed, for example, for transporting liquefied gas. Liquefied gas is stored and transported in such tanks at a low temperature, requiring thermally insulating tank walls in order to keep the liquefied gas at this temperature. It is therefore particularly important to keep the integrity of the tank walls intact, both in order to keep the tank sealed and prevent liquefied gas from leaking out of the tanks, and to prevent the insulating characteristics of the tank from deteriorating in order to keep the gas in its liquefied form.

Such sealed and thermally insulating tanks also comprise an insulating barrier anchored to the double hull of the ship and carrying at least one sealed membrane. For example, such tanks can be produced in accordance with Mark III®-type technologies, as described, for example, in FR2691520, N096®-type technologies, as described, for example, in FR2877638, or others as described, for example, in WO14057221.

Figure 1:
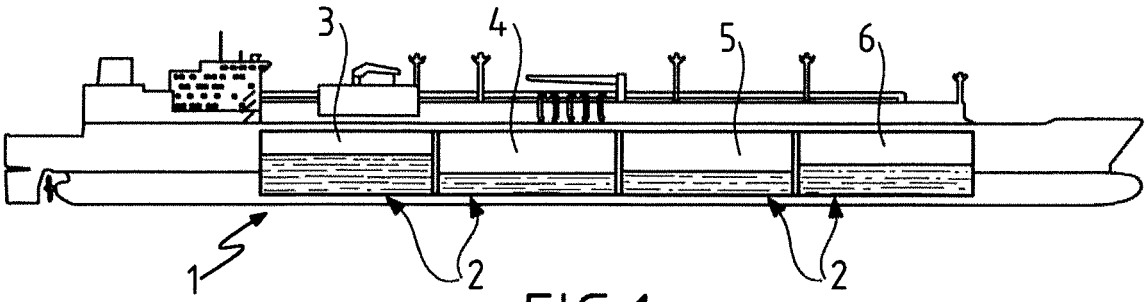
FIG. 1 is a schematic longitudinal cross-sectional view of a ship comprising a plurality of tanks in an initial filling state.

FIG. 1 shows a ship 1 comprising four sealed and thermally insulating tanks 2. On such a ship 1, the tanks 2 are connected to each other by a cargo handling system (not shown) that can include many components, for example pumps, valves and pipes in order to allow liquid to be transferred from one of the tanks 2 to another tank 2.

The four tanks 2 have an initial filling state in FIG. 1. In this initial state, the tanks are partially filled. A first tank 3 is filled to approximately 60% of its capacity. A second tank 4 is filled to approximately 35% of its capacity. A third tank 5 is filled to approximately 35% of its capacity. A fourth tank 6 is filled to approximately 40% of its capacity.

This partial filling of the tanks 3, 4, 5, 6 can give rise to significant risks of damage to said tanks 3, 4, 5, 6 when the ship 1 is sailing at sea. Indeed, when it is at sea, the ship 1 is subject to many movements linked to the sailing conditions. These movements of the ship 1 are passed on to the liquid contained in the tanks 3, 4, 5, 6, which is consequently liable to move in the tanks 3, 4, 5, 6. These movements of the liquid in the tanks 3, 4, 5, 6 result in impacts on the tank 3, 4, 5, 6 walls which can damage the tank 3, 4, 5, 6 walls. However, it is important to maintain the integrity of the tank 3, 4, 5, 6 walls in order to maintain the tight sealing and the insulation characteristics of the tanks 3, 4, 5, 6.

Figure 2:
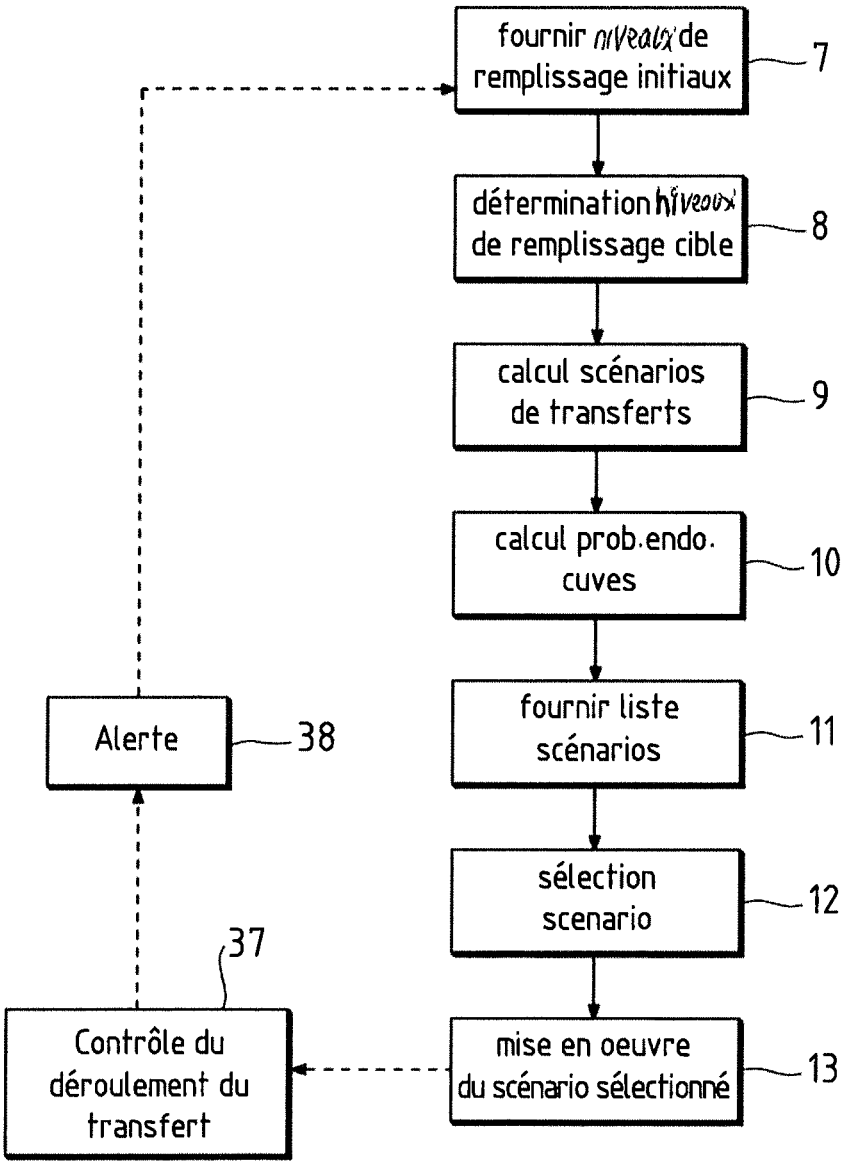
FIG. 2 is a diagram showing the different steps of the method for managing the filling levels of the tanks in order to shift from the initial filling state of FIG. 1 to the target filling state of FIG. 3.
Figure 4:
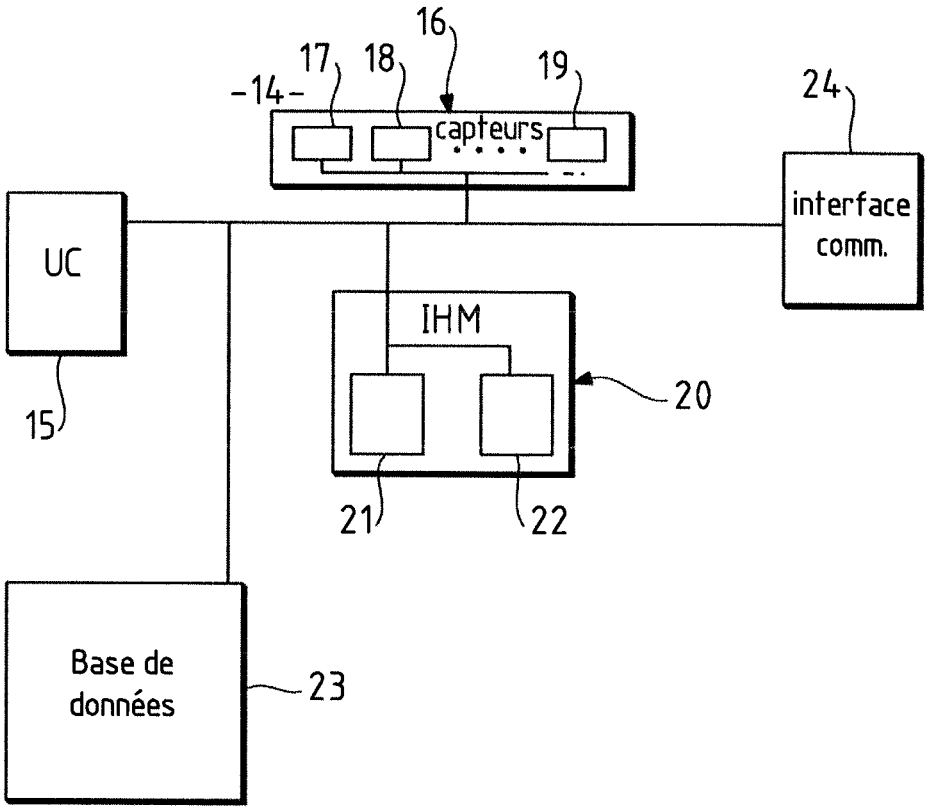
FIG. 4 is a schematic view of a system for managing the filling levels of tanks of the ship of FIG. 1.

In order to prevent damage to the tanks 3, 4, 5, 6, the ship comprises a system for managing the filling levels, one embodiment of which is illustrated in FIG. 4, and the operating method of which is illustrated by FIG. 2.

In reference to FIG. 2, the system for managing the filling levels of the tanks, hereinafter referred to as the management system, first needs to know the initial filling state of the tanks 3, 4, 5, 6. For this purpose, the initial filling levels of the tanks 3, 4, 5, 6 are provided to the management system during a first step 7. These initial filling levels can be provided manually by an operator by means of an acquisition interface of the management system or obtained automatically by any suitable means, for example by means of sensors for sensing the filling levels of tanks 3, 4, 5, 6 (see FIG. 4). These filling levels are, for example, defined as a percentage in terms of the height of liquid in the tank 3, 4, 5, 6.

During a second step 8, the management system determines a target filling state of the tanks 3, 4, 5, 6. In this target filling state, the liquid transported by the ship 1 is distributed between the tanks 3, 4, 5, 6 in such a way as to limit the risks linked to the movements of the liquid in the tanks 3, 4, 5, 6. More particularly, the management system determines a target filling state in which all the liquid transported by the ship is distributed between the different tanks in such a way as to limit the risks linked to the movements of liquid in the tanks. Typically, the management system determines a target filling state in which the liquid transported by the ship is distributed between the tanks 3, 4, 5, 6 in such a way that the tanks are more than 70% full or, on the contrary, less than 10% full.

Figure 3:
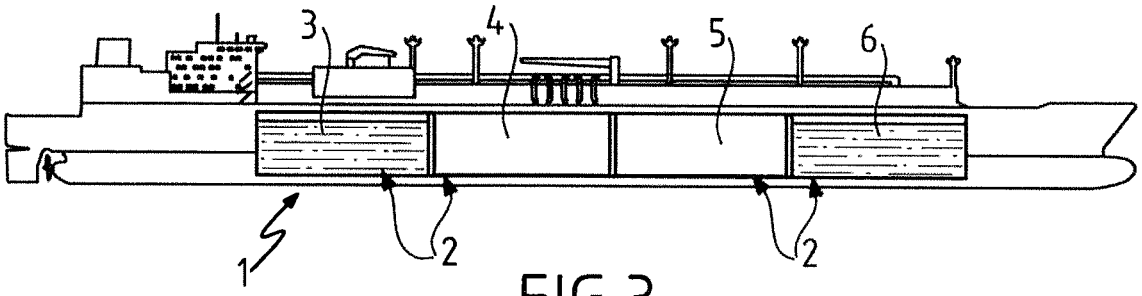
FIG. 3 is a schematic longitudinal cross-sectional view of the ship of FIG. 1 with the tanks in a target filling state.

FIG. 3 shows the ship of FIG. 1 with the tanks 3, 4, 5, 6 in such a target filling state, which helps limit the risks linked to the movements of liquid in said tanks 3, 4, 5, 6. Thus, in FIG. 3, the first tank 3 is 95% full, the second tank 4 and the third tank 5 are 5% full and the fourth tank 6 is 95% full.

The space not occupied by the liquid contained in the tanks 3, 6 is therefore reduced. This reduced residual space limits the movements of said liquid in said tanks 3, 6 and therefore the force of the impacts linked to said movements of said liquid. Therefore, the first tank 3 and the fourth tank 6 have a limited risk of damage linked to the movements of liquid.

Conversely, the second tank 4 and the third tank 5 have a limited risk of damage linked to the movements of liquid due to the fact that the liquid contained in said second and third tanks 4, 6 is of insufficient weight to generate significant impacts on the walls of said tanks 4, 5.

The management system then calculates (step 9) a plurality of transfer scenarios in order to shift from the initial filling state to the target filling state.

These transfer scenarios are calculated based on the initial filling levels in the tanks 3, 4, 5, 6 and the characteristics of the ship 1. In particular, the characteristics of the ship 1 taken into consideration in order to calculate the transfer scenarios comprise at least one parameter from the number of pumps in the tanks 3, 4, 5, 6, the pumping capacities of the pumps, the volume of the tanks 3, 4, 5, 6, and the diameters of the pipes connecting the tanks 3, 4, 5, 6 to each other. Using this data, the management system calculates all the tank-to-tank transfer possibilities, which produces a list of tank-to-tank transfer scenarios in order to reach the target filling levels from the initial filling levels.

Each transfer scenario defines a plurality of transfer phases between the tanks 3, 4, 5, 6. More particularly, each transfer phase defines, for each tank 3, 4, 5, 6 and depending on the liquid transfer capacities between the different tanks 3, 4, 5, 6, one or more flows of liquid to be transferred between the tanks 3, 4, 5, 6. The management system defines, for each transfer phase, a filling level at the beginning of the phase, a filling level at the end of the phase and a transfer time necessary in order to shift from the filling level at the beginning of the phase to the filling level at the end of the phase. These successive transfer phases make it possible to shift from the initial filling state to the target filling state.

However, these transfer phases require a large quantity of liquid to be transferred between the tanks 3, 4, 5, 6. Such a transfer may require a significant amount of time during which the tanks 3, 4, 5, 6 may remain subject to significant risks linked to the movements of liquid. Therefore, after having calculated the different scenarios during step 9, the management system calculates (step 10), for each scenario, the risks of damage to the tanks 3, 4, 5, 6 during the course of said transfer scenario.

In other words, for each transfer scenario, the management system also calculates a probability of damage to the tanks 3, 4, 5, 6 during the course of said transfer scenario.

This probability of damage to the tanks 3, 4, 5, 6 is calculated as a function of many parameters. Several quantities have to be estimated by statistical or physical calculation, by measurements taken in real time, on board or in tests, in order to calculate these probabilities of damage to the tanks 3, 4, 5, 6.

The parameters that can be taken into consideration in order to calculate damage to the tanks 3, 4, 5, 6 can comprise movement parameters of the ship 1, environmental condition parameters of the ship 1, structural parameters of the ship 1 or parameters linked to the liquid contained in the tanks 3, 4, 5, 6.

The movement parameters of the ship are, for example, movement parameters of the ship in the six degrees of freedom of the ship (surge, sway, heave, roll, pitch, yaw) which can be represented in the form of movement, speed, and temporal or spectral acceleration. The movement parameters of the ship can also comprise the ship's course in terms of heading, speed and GPS position.

The environmental condition parameters are linked mainly to the weather. These environmental condition parameters comprise, for example, wind sea height, swell height, wind sea period, swell period, wind sea direction, swell direction, wind force, wind direction, current force, current direction, relative direction of the wind, the swell, the current, the wind sea relative to the ship.

The structural parameters of the ship 1 comprise, for example, the strength of the tank 3, 4, 5, 6 walls depending on the position on the tanks, the strength of the insulation system of the tanks 3, 4, 5, 6 depending on the position on the tank or the statistical behavior of the impacts of the movements of liquid.

The parameters linked to the liquid contained in the tanks 3, 4, 5, 6 are, for example, the levels (force, pressure, amplitude, frequency, surface area) of the impacts of liquid on the walls of the tanks 3, 4, 5, 6, the time spent at different filling levels of the tanks 3, 4, 5, 6, the level of evaporation of liquefied gas induced by the transfer of liquid, the loading state of the ship 1 structure.

Therefore, the management system calculates, for each scenario, the total time of the operation to shift from the initial filling state to the final filling state and the risk of damage to the walls of tanks 3, 4, 5, 6 during said operation. This risk of damage to the insulation is calculated according to the following function:

$$\mathrm{Risk}_{ope} = \prod_{tk_n} \int_0^{surf} \int_0^{t_{ope}} prob_{tk_n}(Pres_{surf} > Res_{surf}, \mathrm{tk_n}, SC(\mathrm{fl_n})) \cdot dsurf \cdot dt$$

in which tk_n represents the number of the tank n,

SC represents the sailing conditions as a function of the filling level fl_n of the tank tk_n, $\mathrm{Prob}_{tk_n}$ represents the probability density of encountering a pressure $\mathrm{Pres}_{surf}$ on an internal surface of the tank tk_n greater than the strength $\mathrm{Res}_{surf}$ of said internal surface of the tank tk_n as a function of the sailing conditions SC(fl_n), surf is the internal surface impacted by the liquid, and $t_{ope}$ is the duration of the operation to shift from the initial state to the target state.

The sailing conditions SC can also depend on at least one of the following parameters:

the angle of incidence between the sea state and the ship the period of the sea state the significant height of the sea state the movements of the ship the forward speed of the ship.

It should be noted that a sea state can be broken down into wind sea and swell, and even cross swell. Therefore, a sea state can be defined with several components.

The laws $\mathrm{Prob}_{1k}$ are statistical laws, for example GEV-, Weibull-, Pareto- or Gumbel-type laws. One, more or all of the parameters of these laws are defined, for example, using liquid movement tests performed in a laboratory or onboard measurement campaigns at carried out at sea.

The management system thus provides a list of transfer scenarios (step 11) and different information linked to said calculated transfer scenarios. Moreover, the scenarios are preferably ranked according to the acceptance criterion, for example from the highest risk scenario to the lowest risk scenario in terms of damage to the tanks 3, 4, 5, 6.

A scenario is then selected (step 12) depending on the acceptance criterion.

Preferably, each scenario is provided in the form of a set of control signals and/or instructions for implementing the different transfer phases of said transfer scenario. For example, the scenario can comprise a series of instructions provided in a human-readable format and capable of precisely guiding an operator throughout the transfer period in order to execute the transfer scenario.

According to one embodiment, the scenario can be provided in the form of a series of instructions in a computerreadable format and/or a series of control signals intended to control the components of the cargo handling system, for example actuating the ship's pumps, switching the valves, etc., in order to execute the transfer scenario.

The acceptance criterion can be in many forms. This acceptance criterion can be predefined or chosen by the operator. For example, whether it is predefined or chosen by the operator, this acceptance criterion can be the risk of damage to the tanks 3, 4, 5, 6, the sailing range available after the transfers, the total time taken by the transfer scenario, or other.

The selected transfer scenario that satisfies the acceptance criterion is then implemented (step 13) in order to shift from the initial filling state to the target filling state.

As indicated above, the different quantities corresponding to the parameters necessary in order to calculate scenarios (step 9) and calculate the probabilities of damage (step 10) can be obtained or estimated by statistical or physical calculation, by measurements taken in real time, on board or in tests.

FIG. 4 shows an example of the structure of the management system 14. This management system 14 comprises a central processing unit 15. This central processing unit 15 is configured to perform the different calculations of transfer scenarios and probabilities of damage to the tanks 3, 4, 5, 6 (steps 9 and 10). This central processing unit 15 is connected to a plurality of onboard sensors 16 for obtaining the different quantities indicated above. Thus, the sensors 16 comprise, for example and not exhaustively, a sensor sensing the flow rate of the pumps 17, a filling level sensor for each tank 18, various sensors 19 (accelerometer, stress gauge, deformation gauge, sound sensor, light sensor) allowing the central processing unit 15 to detect, via a dedicated algorithm, the impacts linked to the movements of the liquid in the tanks 3, 4, 5, 6, etc.

The management system 14 further comprises a human-machine interface 20. This human-machine interface 20 comprises a display means 21. This display means 21 allows the operator to obtain the various pieces of information. This information is, for example, information on the different transfer scenarios, the instructions to implement said transfer scenarios, the quantities obtained by the sensors 16 such as the intensity of the movements of liquid in the tanks, information on the impacts linked to these movements of liquid, the movements of the ship, the loading state of the ship or meteorological information.

The human-machine interface 24 further comprises an acquisition means 22 allowing the operator to manually provide quantities to the central processing unit 15, typically in order to provide the central processing unit 15 with data that cannot be obtained by sensors because the ship does not comprise the necessary sensor or the latter is damaged. For example, in one embodiment, the acquisition means allows the operator to input information on the number of pumps and the maximum height of the waves.

The management system 14 comprises a database 23. This database 23 comprises, for example, certain quantities obtained in a laboratory or during onboard measurement campaigns carried out at sea.

The management system 14 also comprises a communication interface 24 allowing the central processing unit 15 to communicate with remote devices, for example in order to obtain meteorological data, position data of the ship or other.

Figure 5:
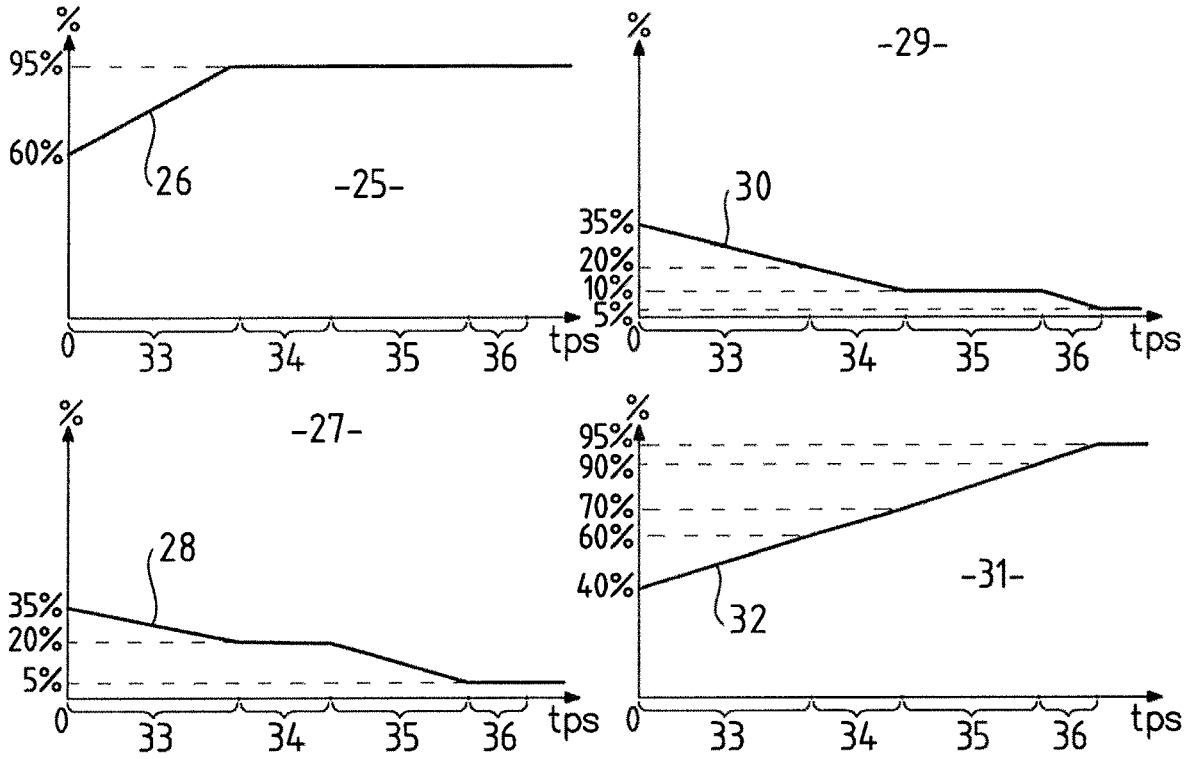
FIG. 5 is a plurality of graphs illustrating the transfers of liquid over time for shifting from the initial filling state of FIG. 1 to the target filling state of FIG. 2.

FIG. 5 shows graphs illustrating the filling levels of the tanks 3, 4, 5, 6 over time. Thus, a first graph 25 illustrates the filling level 26 of the first tank 3 over time. A second graph 27 illustrates the filling level 28 of the second tank 4 over time. A third graph 29 illustrates the filling level 30 of the third tank 5 over time. A fourth graph 31 illustrates the filling level 32 of the fourth tank 6 over time.

During a first phase 33 of the selected transfer scenario, the valves of the ship 1 are configured to connect the first tank 3 and the second tank 4 and to connect the third tank 5 and the fourth tank 6. Moreover, the pumps of the tanks 3, 4, 5, 6 are configured to transfer the liquid contained in the second tank 4 towards the first tank 3 and to transfer the liquid contained in the third tank 5 towards the fourth tank 6.

The first graph 25 and the second graph 27 show that the first tank 3 receives liquid from the second tank 4 during this first phase 33 of the transfer scenario. Thus, the first graph 25 shows that the filling level 26 of the first tank 3 shifts from an initial filling level of 60% to a target filling level of 95% during the first phase 33. Similarly, the second graph 27 shows that the second tank 4 is emptied so as to shift from an initial filling level of 35% to a filling level at the end of the first phase of 20%.

During this first phase 33, the liquid contained in the third tank 5 is transferred towards the fourth tank 6. Thus, the filling level 30 of the third tank 5 shifts from an initial filling level of 35% to a filling level at the end of the first phase of 20% and the filling level 32 of the fourth tank 6 shifts from 40% to a filling level at the end of the first phase of 60%.

During a second phase 34 of the transfer scenario, the valves of the ship 1 are switched to connect the second tank 4 to the fourth tank 6. This switching of the valves requires many handling maneuvers and therefore requires a certain amount of time. During these handling maneuvers, the liquid contained in the third tank 5 continues to be transferred towards the fourth tank 6, the third tank 5 having a filling level at the end of the second phase of 10% and the fourth tank 6 having a filling level at the end of the second phase of 70%.

Since the pipes connected to the fourth tank 6 and the pumps of the fourth tank 6 do not allow a flow of liquid originating simultaneously from the third tank 5 and from the second tank 4 to be absorbed, only the second tank 4 connected to the fourth tank 6 is emptied to continue filling the fourth tank 6 during a third phase 35 of the transfer scenario.

Indeed, at the start of the third phase 35, corresponding to the end of the handling maneuvers for connecting the second tank 4 to the fourth tank 6, the second tank 4 is still 20% full while the third tank 5 now only has a filling level of 10%. It is therefore preferable to first empty the second tank 4, whose filling level presents a higher risk than that of the third tank 5. Thus, during the third phase 35 of the transfer scenario, only the liquid contained in the second tank 4 is transferred into the fourth tank 6. The second tank 4 thus has a filling level at the start of the third phase of 20% and a filling level at the end of the third phase of approximately 5%.

Once the second tank is substantially empty, the pipes and the pumps of the ship are switched to transfer the liquid contained in the third tank 5 towards the fourth tank 6. Thus, in a fourth phase 36 of the transfer scenario, the as yet untransferred liquid contained in the third tank 5 is transferred towards the fourth tank 6 such that the final filling level of the third tank 5 is of the order of 5% and the target filling level of the fourth tank 6 is of the order of 95%.

The switching of the valves and the activation of the pumps allowing the transfers between the tanks can be manual and/or automated. In the case of manual operations, the human-machine interface 20 provides the operator with a sequence of instructions for implementing the transfer scenario. The management system 14 takes a time period corresponding to these operations into account in its calculations (steps 9 et 10).

Preferably, the management system 14 monitors the progress of the selected scenario (step 37, FIG. 2) in real time. In the event of discrepancies between the actual state of the filling levels 26, 28, 30, 32 predicted according to the selected scenario and the actual filling levels, real-time or advance warnings are sent to the user in order to warn him or her of these discrepancies (step 38, FIG. 2). Such warnings can also be sent to the operator if the weather conditions, the movements of liquid in the observed tanks, the movements of the ship or other develop differently, such that they could give rise to differences in how the transfer scenario develops.

If a discrepancy is observed between the selected transfer scenario and the actual state of the tanks 3, 4, 5, 6 over time, for example because the actual pumping flow rate of some pumps was overestimated when calculating the transfer scenarios (step 9), the management system 14 can restart the calculation process shown in FIG. 2 in order to apply new transfer scenarios or propose same to the operator. Preferably, this new calculation of the scenarios is carried out taking into account the relevant collected data that resulted in this discrepancy, for example the actual observed flow rate of the pumps. Moreover, in one embodiment, this new calculation of the scenarios is carried out by directly selecting the same target filling state as the target filling state determined at the first iteration of said calculation. In other words, the calculation shown in FIG. 2 is repeated directly from the step of calculating the scenarios.

The technique described above for managing the filling levels of the tanks can be used in different types of containers, for example for an LNG container in a floating structure such as an LNG carrier ship, or in other applications.

Figure 6:
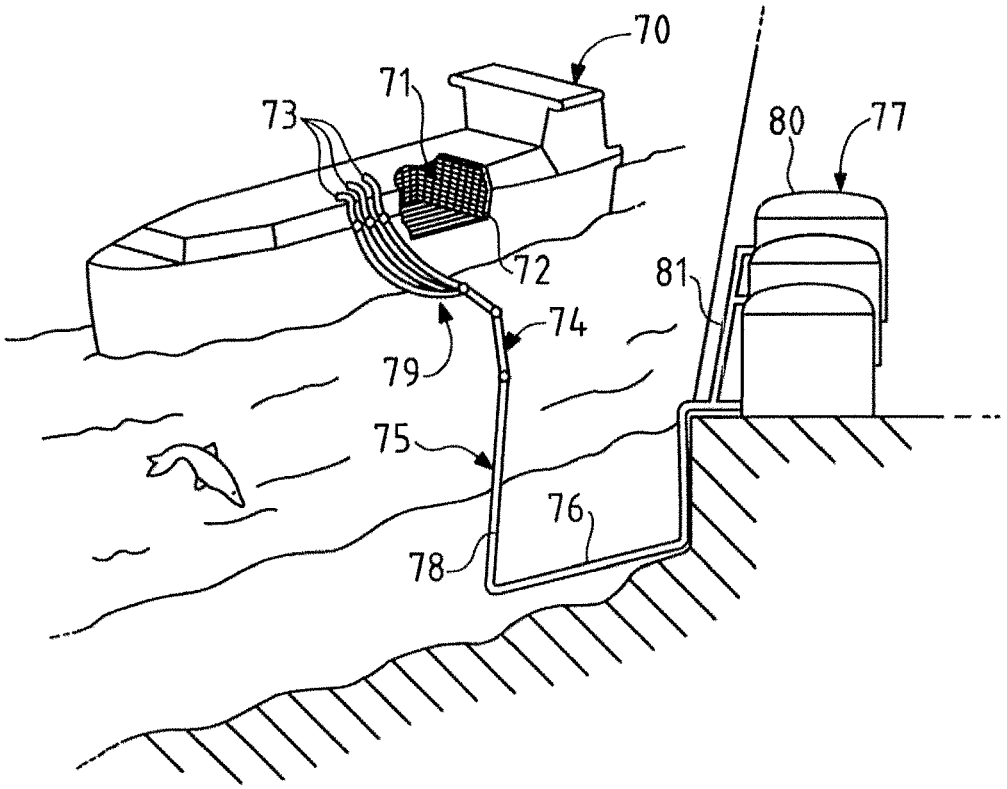
FIG. 6 is a schematic cutaway view of a tank of an LNG carrier ship comprising a system for managing the filling levels of tanks and a terminal for loading/unloading this tank.

In reference to FIG. 6, a cutaway view of an LNG carrier ship 70 shows a sealed and insulated tank 71 that is generally prismatic in shape mounted in the double hull 72 of the ship. The wall of the tank 71 comprises a primary sealed barrier intended to be in contact with the LNG contained in the tank, a secondary sealed barrier arranged between the primary sealed barrier and the double hull 72 of the ship, and two insulating barriers arranged respectively between the primary sealed barrier and the secondary sealed barrier and between the secondary sealed barrier and the double hull 72.

In a manner known per se, loading/unloading pipes 73 arranged on the top deck of the ship can be connected, by means of suitable connectors, to a marine or port terminal in order to transfer a cargo of LNG to or from the tank 71.

FIG. 6 shows an example of a marine terminal comprising a loading and unloading station 75, a submarine pipe 76 and a land-based facility 77. The loading and unloading station 75 is a fixed offshore facility comprising a movable arm 74 and a tower 78 that supports the movable arm 74. The movable arm 74 carries a bundle of insulated flexible pipes 79 that can be connected to the loading/unloading pipes 73. The orientable movable arm 74 adapts to all sizes of LNG carrier. A connecting pipe not shown here extends into the tower 78. The loading and unloading station 75 allows the LNG carrier 70 to be loaded and unloaded from or to the land-based facility 77. This comprises liquefied gas storage tanks 80 and connecting pipes 81 linked by the submarine pipe 76 to the loading and unloading station 75. The submarine pipe 76 allows liquefied gas to be transferred between the loading and unloading station 75 and the land-based facility 77 over a long distance, for example 5 km, which allows the LNG carrier ship 70 to be kept a long distance from the coast during the loading and unloading operations.

In order to generate the pressure required to transfer the liquefied gas, pumps installed in the ship 70 and/or pumps equipping the land-based facility 77 and/or pumps equipping the loading and unloading station 75 are implemented.

Although the invention has been described in relation to several specific embodiments, it is obvious that this does not in any way limit it, and that it comprises all the technical equivalents of the described means and the combinations of same, provided they are covered by the context of the invention.

Some of the elements, in particular the components of the management system, can be produced in different forms, in a unitary or distributed manner, by means of hardware and/or software components. Hardware components that can be used are ASIC-specific integrated circuits, FPGA programmable logic arrays or microprocessors. Software components can be written in various programming languages, for example C, C++, Java or VHDL. This list is not exhaustive.

The use of the verbs "comprise" or "include" and their conjugated forms does not exclude the presence of elements or steps other than those disclosed in a claim. The use of the indefinite article "a" or "an" for an element or step does not exclude the presence of a plurality of such elements or steps, unless otherwise specified. In particular, the use of the indefinite article "a" or "an" relating to the step of determining a target state defining final filling levels of the tanks does not exclude the determination of several target states, each defining final filling levels of the tanks.

The invention claimed is:

1. A management method for managing the filling levels of a plurality of tanks arranged in a ship, said tanks being connected in such a way as to allow liquid to be transferred between said tanks, the method comprising providing an initial state defining initial filling levels of the tanks providing at least one environmental parameter defining environmental data of the ship, said at least one environmental parameter comprising a wind sea height and/or a swell height, determining a target state defining final filling levels of said tanks, determining a liquid transfer scenario, the transfer scenario defining one or more flows of liquid to be transferred between the tanks during a transfer period in order to shift from the initial state to the target state of the tanks, calculating a probability of damage to the tanks as a function of successive filling levels of the tanks during the transfer period and of said at least one environmental parameter, the probability of damage to the tanks defining a probability that at least one tank will be damaged during the course of the transfer scenario, and generating a series of instructions intended to transfer the liquid between the tanks in accordance with said transfer scenario in response to the probability of damage to the tanks satisfying an acceptance criterion.

2. The management method as claimed in claim 1, further comprising, in response to the probability of damage to the tanks satisfying the acceptance criterion, transferring the liquid between the tanks in accordance with said transfer scenario.

3. The management method as claimed in claim 1, further comprising providing a transfer capacity parameter defining a transfer capacity between the tanks, the transfer scenario being determined according to said parameter defining the transfer capacity between the tanks.

4. The management method as claimed in claim 1, in which the probability of damage to the tanks is calculated as a function of at least one parameter chosen from the group of parameters comprising the movements of the ship, the levels of liquid impacts on the tank walls, the statistical behavior of the impacts of the movements of liquid, the strength of the tanks depending on the position in said tanks, the time spent at different filling levels, the gas evaporation rate induced by the transfer of liquid, and the loading state of the ship's structure.

5. The management method as claimed in claim 1, further comprising the step of determining a parameter in real time and taking said parameter into account in order to determine the transfer scenario.

6. The management method as claimed in claim 1, further comprising the step of determining a parameter in real time and taking said parameter into account in order to determine the calculation of probability of damage to the tanks.

7. The management method as claimed in claim 1, in which the acceptance criterion is a criterion concerning the risk of damage to the tanks during the course of the transfer scenario.

8. The management method as claimed in claim 1, in which the probability of damage to the tanks is calculated according to the following formula:

$$\mathrm{Risk}_{ope} = \prod_{tk_n} \int_0^{surf} \int_0^{t_{ope}} prob_{tk_n}(Pres_{surf} > Res_{surf}, \mathrm{tk_n}, SC(\mathrm{fl_n})) \cdot dsurf \cdot dt$$

in which tk_n represents the number of the tank n,

SC represents the sailing conditions as a function of the filling level fl_n of the tank tk_n, $\mathrm{Prob}_{tk_n}$ represents the probability density of encountering a pressure $\mathrm{Pres}_{surf}$ on an internal surface of the tank tk_n greater than the strength $\mathrm{Res}_{surf}$ of said internal surface of the tank tk_n as a function of the sailing conditions SC(fl_n), surf is the internal surface impacted by the liquid, and $t_{ope}$ is the duration of the operation to shift from the initial state to the target state.

9. The management method as claimed in claim 8, in which the probability density $\mathrm{Prob}_{tk_n}(\mathrm{Pres}_{surf} > \mathrm{Res}_{surf}, \mathrm{tk_n}, \mathrm{SC(fl_n)})$ is predefined.

10. The management method as claimed in claim 1, in which the method further comprises the step of continuously monitoring the actual successive states of the tanks during the transfer period and, in response to the detection of a discrepancy between the actual successive states of the tanks and the predicted successive states of tanks determined by the transfer scenario, repeating the method of claim 1.

11. The management method as claimed in claim 1, further comprising:

determining a plurality of different transfer scenarios, each transfer scenario defining one or more flows of liquid to be transferred between the tanks during a respective transfer period in order to shift from the initial state to the target state, calculating, for each transfer scenario, a respective probability of damage to the tanks as a function of successive filling levels of the tanks during the corresponding transfer period, the probability of damage to the tanks defining a probability that at least one tank will be damaged during the course of said transfer scenario, selecting one scenario from the plurality of transfer scenarios, and generating the series of instructions intended to transfer the liquid between the tanks in accordance with the selected transfer scenario in response to the corresponding probability of damage to the tanks satisfying an acceptance criterion.

12. The management method as claimed in claim 1, further comprising:

determining a plurality of target states, each target state defining final filling levels of the tanks, determining a plurality of different transfer scenarios, each transfer scenario defining one or more flows of liquid to be transferred between the tanks during a respective transfer period in order to shift from the initial state to one target state from the plurality of target states, calculating, for each transfer scenario, a respective probability of damage to the tanks as a function of successive filling levels of the tanks during the corresponding transfer period, the probability of damage to the tanks defining a probability that at least one tank will be damaged during the course of said transfer scenario, selecting one scenario from the plurality of transfer scenarios, and generating the series of instructions intended to transfer the liquid between the tanks in accordance with the selected transfer scenario in response to the corresponding probability of damage to the tanks satisfying an acceptance criterion.

13. The management method as claimed in claim 11, in which the scenario is selected depending on the acceptance criterion.

14. A computer-implemented management system of the filling levels of tanks, said tanks being arranged in a ship and connected in such a way as to allow liquid to be transferred between said tanks, the system comprising means for:

providing an initial state defining initial filling levels of the tanks, providing at least one environmental parameter defining environmental data of the ship, said at least one environmental parameter comprising a wind sea height and/or a swell height, determining a target state defining final filling levels of said tanks, determining a liquid transfer scenario, the transfer scenario defining one or more flows of liquid to be transferred between the tanks during a transfer period in order to shift from the initial state to the target state of the tanks, calculating a probability of damage to the tanks as a function of successive filling levels of the tanks during the transfer period and of said at least one environmental parameter, the probability of damage to the tanks defining a probability that at least one tank will be damaged during the course of the transfer scenario, and generating a series of instructions intended to transfer the liquid between the tanks in accordance with said transfer scenario in response to the probability of damage to the tanks satisfying an acceptance criterion.

* * * * *